US009516938B2

(12) United States Patent
Richmond et al.

(10) Patent No.: US 9,516,938 B2
(45) **Date of Patent: *Dec. 13, 2016**

(54) HAIR STYLER

(71) Applicant: TRADE BOX, LLC, Culver City, CA (US)

(72) Inventors: David Richmond, Culver City, CA (US); Howard Richmond, Los Angeles, CA (US); Michael Ragosta, Calabasas, CA (US); Bruno Meglio, Beverly Hills, CA (US); Claudio Marino, Woodland Hill, CA (US); Henry Yu, El Segundo, CA (US); Jefferson McCrory, El Segundo, CA (US)

(73) Assignee: TRADE BOX, LLC, Culver City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/049,845

(22) Filed: Oct. 9, 2013

(65) Prior Publication Data

US 2014/0033558 A1 Feb. 6, 2014

Related U.S. Application Data

(63) Continuation of application No. 13/427,161, filed on Mar. 22, 2012, now Pat. No. 8,607,470.

(51) Int. Cl.

| | |
|---|---|
| ***A45D 20/10*** | (2006.01) |
| ***A45D 20/48*** | (2006.01) |
| ***A45D 20/50*** | (2006.01) |
| ***A45D 1/04*** | (2006.01) |
| ***A45D 2/00*** | (2006.01) |
| *A45D 1/00* | (2006.01) |

(52) U.S. Cl.

CPC ..... *A45D 20/10* (2013.01); *A45D 1/04* (2013.01); *A45D 2/002* (2013.01); *A45D 2001/004* (2013.01)

(58) Field of Classification Search

CPC ..... A45D 20/04; A45D 20/10; A45D 20/122; A45D 20/124; A45D 1/04; A45D 2/002; A45D 2001/002

USPC ..... 34/283, 96, 97, 98, 99, 100; 132/212; 392/379–385

See application file for complete search history.

(56) References Cited

U.S. PATENT DOCUMENTS

| | | | | |
|---|---|---|---|---|
| 3,840,030 | A | 10/1974 | Baker | |
| 3,964,502 | A | 6/1976 | Komatsu | |
| 5,146,695 | A | 9/1992 | Yang | |
| 8,607,470 | B2 * | 12/2013 | Richmond et al. | 34/90 |

(Continued)

FOREIGN PATENT DOCUMENTS

CA 2083086 A1 * 5/1994 ..... A45D 20/122

*Primary Examiner* — Jiping Lu

(74) *Attorney, Agent, or Firm* — Laura M. Lloyd; Leech Tishman Fuscaldo & Lampl

(57) ABSTRACT

A hair styling and drying apparatus has a pair of pivotally connected arms, styling surfaces on the arms, air suction and discharge orifices in the styling surfaces, and a blower for blowing air through the air orifices and recycling air between the arms. At least some suction orifices of one styling surface can align with at least some discharge orifices of the other styling surface. The blowers blow air out the discharge orifices and suck air into the suction orifices, thereby recycling much of the blown air. The apparatus can include heaters for heating the blown air and for heating the styling surfaces.

26 Claims, 4 Drawing Sheets

(56) References Cited

U.S. PATENT DOCUMENTS

| | | | | |
|---|---|---|---|---|
| 2004/0045570 | A1* | 3/2004 | Yao | A45D 1/02<br>132/224 |
| 2005/0224091 | A1 | 10/2005 | Cafaro et al. | |
| 2011/0056509 | A1 | 3/2011 | Benest et al. | |

* cited by examiner

HAIR STYLER

BACKGROUND

This application is a continuation of U.S. application Ser. No. 13/427,161, filed on Mar. 22, 2012, the entire contents of which are incorporated herein by reference. This invention relates to a hair styling apparatus, and more specifically, to a hair styling tool allowing a user to style freshly washed hair.

Hair dryers work to dislodge wet hair strands from one another and to dry off excess moisture, but use of them alone can result in tangled or frizzy hair. Conventional styling tools, such as curling irons, flat irons and heated hair curlers are not made to take wet washed hair and dry it, but to style damp dry hair. Drying and styling freshly washed hair can therefore be a time consuming, multi-step process when done using conventional hand-held hair styling and drying devices. A user usually first dries their wet hair until it is just slightly damp since wet hair cannot be styled. The user then styles the partially dried hair.

In addition to taking at least two time consuming steps, this multi-step process often requires the user to purchase and use more than one device, namely a hair dryer and a styling device such as a curling iron, flat iron, crimping iron and/or curlers. Further, a user may want to add "lift" or "body" to their styled hair. This is difficult for an inexperienced stylist to achieve, especially when a smooth, straight hair style is desired.

Therefore, there is a need for a hair styling apparatus that is efficient, that both dries and styles freshly washed or wet hair, that is easy to use, that an inexperienced user can use to create "lift" and "body" and that can style hair faster than conventional hair dryers and styling irons.

SUMMARY

A hair styling apparatus having features of the present invention can satisfy this need. The apparatus comprises first and second opposed arms movably connected to each other with an open position for placement of hair there between and a closed position for hair styling, each arm having a styling surface facing the other arm in the closed position. A discharge orifice and a suction orifice are in the styling surface of the first arm. There is a first blower for blowing air through the discharge orifice and sucking air from the suction orifice. Optionally, there is a heater for heating air blown by the first blower.

There can also be a second blower, and can further be a second heater for heating air blown by the second blower. In preferred embodiments, the blower is one or more cross-flow blowers. The blower can optionally be one or more axial fans.

Preferably, there is both a discharge orifice and a suction orifice in the styling surface of the second arm and that, when the apparatus is in its closed position, the discharge orifice of the first arm can be at least partly directly opposed to the suction orifice of the second arm. Additionally, in that same closed position, the discharge orifice of the second arm can be at least partly directly opposed to the suction orifice of the first arm. This permits air blown through the discharge orifice of one arm to be sucked into the suction orifice of the other arm.

The orifices can define different shapes, including an elongated shape. They can be covered by a screen or mesh. Each arm can additionally include a vent through which ambient air can be sucked into the apparatus by a blower.

The apparatus can comprise one or more hair separation projections aligned along the edge or edges of the styling surfaces. Optionally, these projections can be mounted on a removable styling attachment.

The apparatus can be used by the steps of: grasping the apparatus; placing hair between the arms of the apparatus with the arms in the open position; moving the arms to the closed position; and blowing heated air through the discharge orifices and sucking air into the suction orifices while moving the arms through the hair.

DRAWINGS

These and other features, aspects and advantages of the present invention will become better understood with regard to the following description, appended claims and accompanying drawings where:

DESCRIPTION

The present invention is directed to a hair styling apparatus capable of styling hair, and a method for doing the same. In the following description, numerous specific details are set forth to provide a more thorough description of embodiments of the invention. It will be apparent, however, to one skilled in the art, that the embodiments of the present invention can be practiced without these specific details. In other instances, well known features have not been described in detail so as not to obscure the invention.

Figure 1:
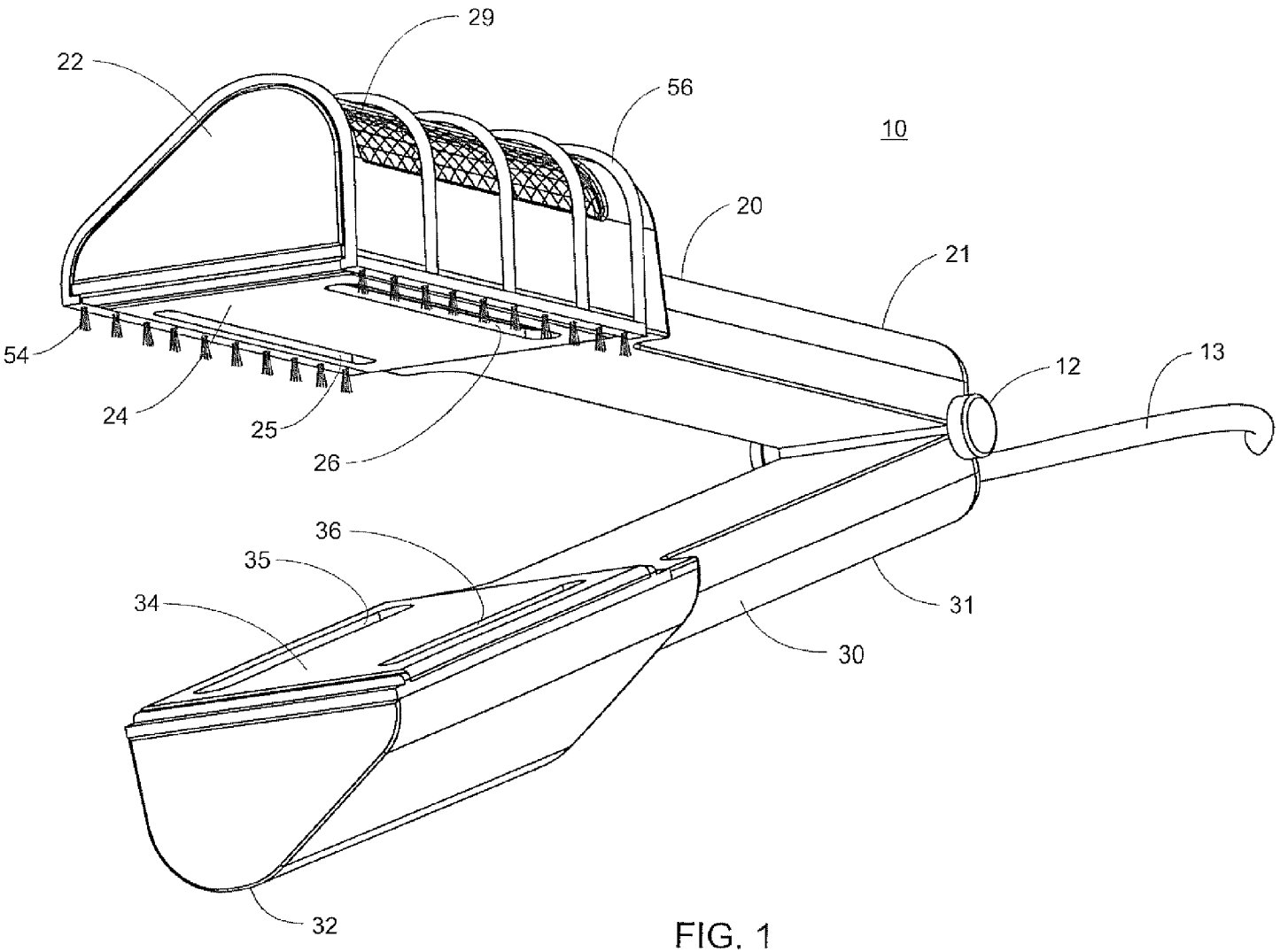
FIG. 1 is a left, front perspective view of an exemplary hair styling apparatus with a removable styling attachment having features of the present invention in an open position.
Figure 2:
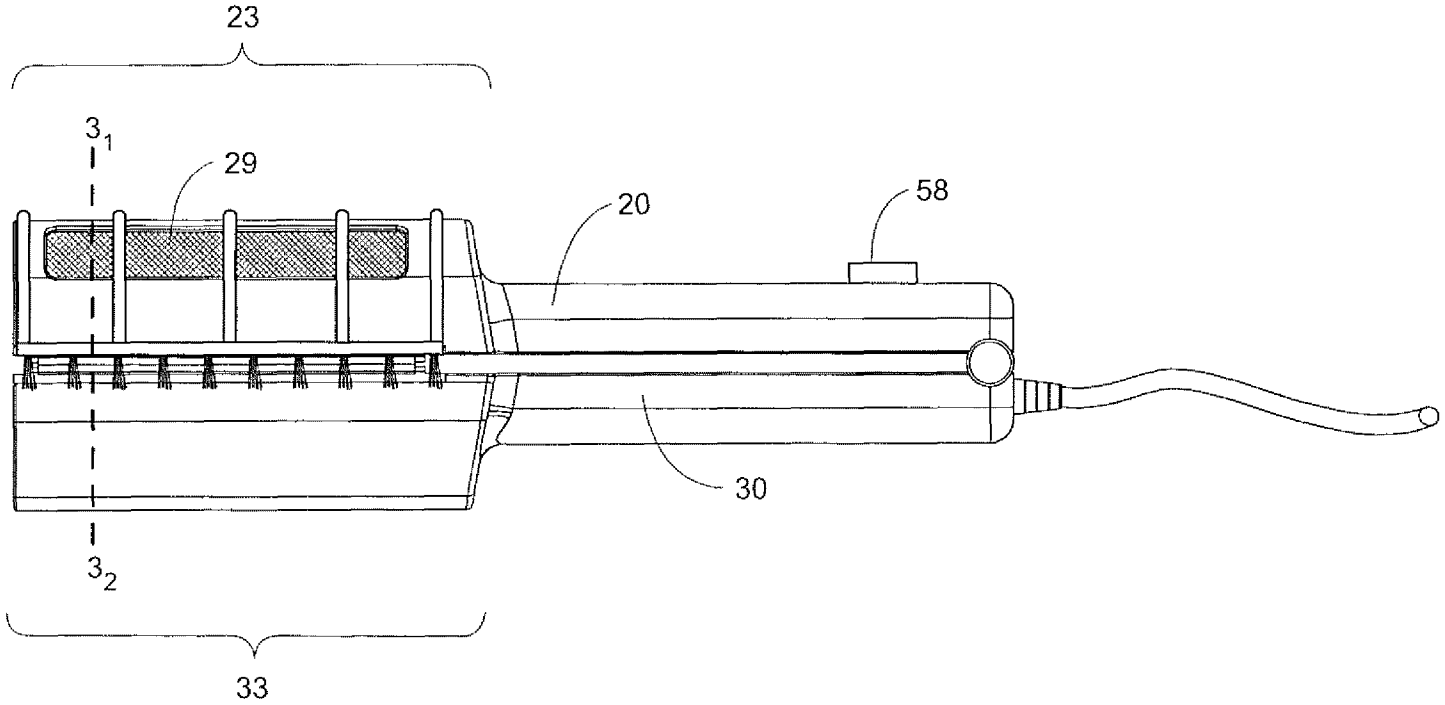
FIG. 2 is a side elevation view of the apparatus of FIG. 1 in a closed position.

With reference to FIGS. 1 and 2, a hair styling apparatus 10 having features of the present invention comprises first and second opposed arms 20, 30. The arms 20, 30 are connected and moveable relative to one another through a connector 12. The arms 20, 30 can move between an open position as shown in FIG. 1 for placement of hair there between and a closed position for hair styling as shown in FIG. 2. In one embodiment, the connector 12 is a pivoting connector. A power cord 13 supplies electricity to the apparatus 10.

Each arm 20, 30 has a proximal section 21, 31 and a distal section 22, 32. Preferably each arm has a styling head 23, 33 at the distal section 22, 32. The arms 20, 30 are pivotably connected to each other, with the connector 12 at the proximal section 21, 31, and hair can be placed there between for hair styling, with or without drying. The arms 20, 30 can be formed of any heat tolerant material, such as metal or plastic.

Figure 3:
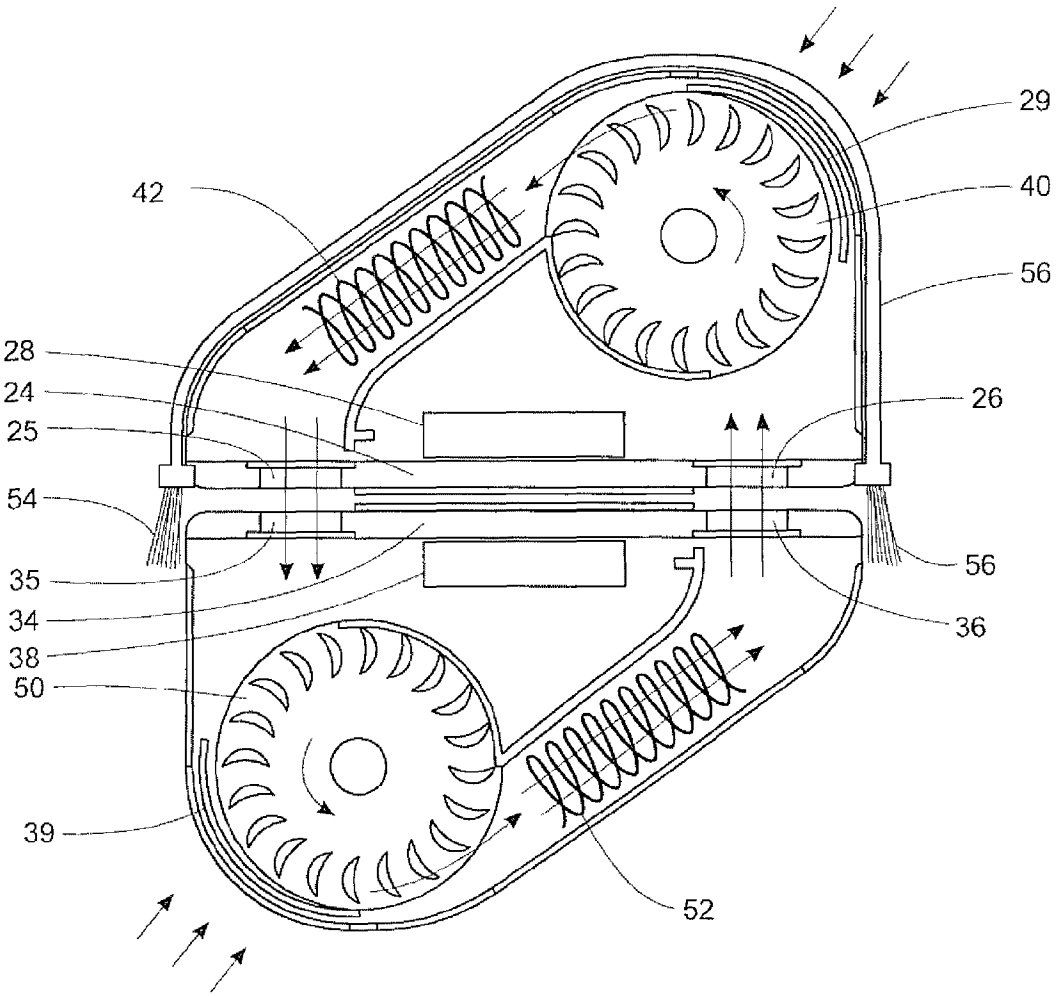
FIG. 3 is a front elevation view of the apparatus of FIG. 1 taken along line $\mathbf{3}_1$-$\mathbf{3}_2$ in FIG. 2.

Each of the arms 20, 30 has a styling surface 24, 34 facing each other in the closed position. The styling surface 24 of the first arm 20 has an air discharge orifice 25 and an air suction orifice 26. With reference to FIG. 3, a first blower 40 positioned in the first arm 20 blows air through the discharge orifice 25 and sucks air through the suction orifice 26.

Figure 4:
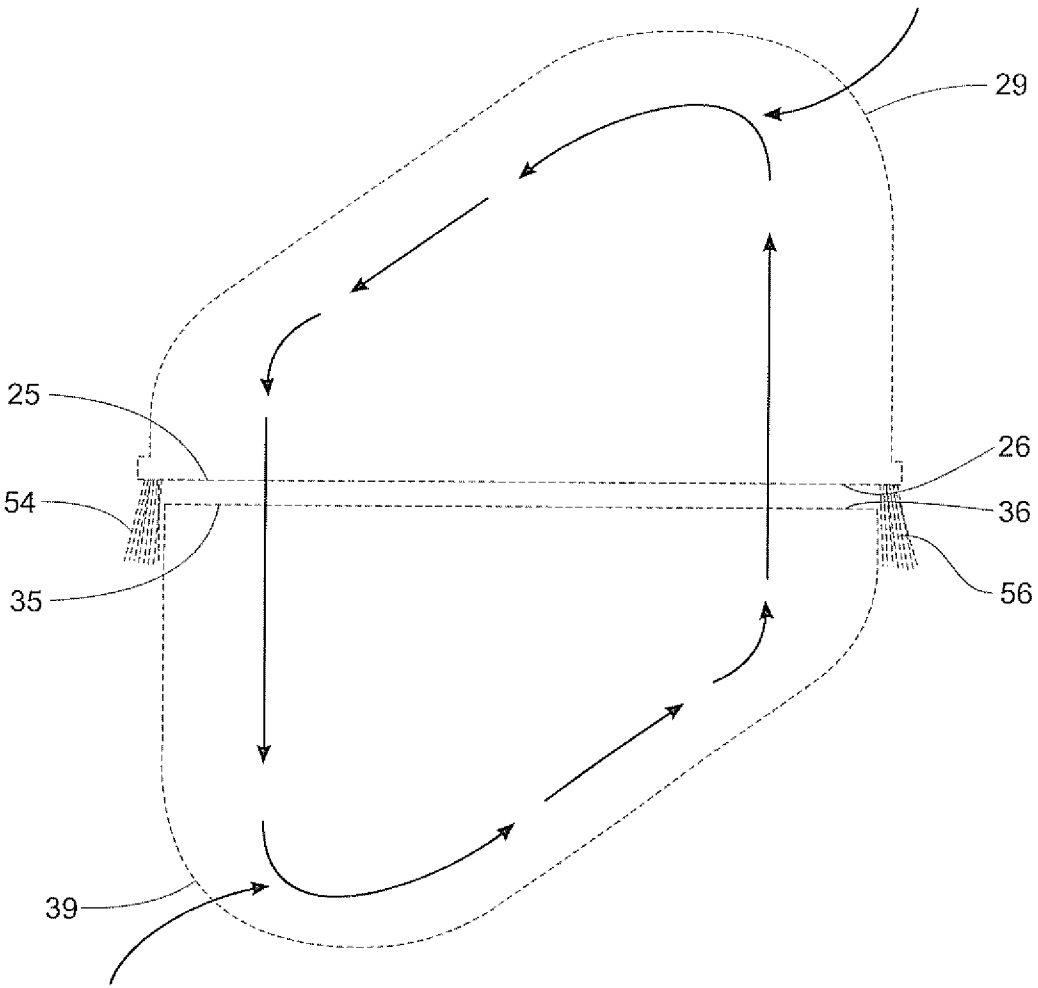
FIG. 4 is a front elevation view of the apparatus of FIG. 1 without a removable styling attachment.

With reference to FIGS. 1, 3 and 4, preferably the styling surface 34 of the second arm has an air suction orifice 35 and an air discharge orifice 36. The second arm 30 can optionally comprise a second blower 50 for blowing air through the discharge orifice 36 of the second arm 30 and sucking air from the suction orifice 35 of the second arm 30.

Preferably, in the closed position, the first surface's discharge orifice 25 is at least partly directly opposed to the second surface's suction orifice 35. In the closed position, the second surface's discharge orifice 36 is preferably at least partly directly opposed to the first surface's suction orifice 26 for improved air flow and to minimize pressure drop. In a most preferred version, each suction orifice is directly opposed a discharge orifice.

As shown in FIG. 4, in a preferred embodiment, when the hair styling apparatus 10 is closed, the first and second styling surfaces 24, 34 can contact one another and air blown by the first blower 40 is recycled through the apparatus 10 out the discharge orifice 25 of the first arm 20, in through the suction orifice 35 of the second arm 30, out through the discharge orifice 36 of the second arm 30, and then in through the suction orifice 26 of the first arm 20 by the first blower 40. In another preferred embodiment, a second blower 50 is positioned in the second arm 30 to increase the volume of air being recycled between the first and second arms 20, 30 through the same orifices as the first blower 40. Optionally, the blowers 40, 50 can comprise cross-flow fans or axial fans. In a preferred embodiment, in the closed position, the first styling surface 24 and the second styling surface 34 are in contact.

As shown in FIG. 3, in one embodiment, a first heater 42 is provided for heating air blown by the first blower 40. In another embodiment, a second heater 52 for heating air blown by the second blower 50 is provided in addition to the first heater 42. Optionally, the heaters for heating air blown by the blowers are bare, coiled nichrome wire that is wrapped around insulating mica heating boards. Other heaters commonly used can include positive temperature coefficient heaters and metal ceramic heaters.

In a preferred embodiment, air blown by the blowers 40, 50 is recycled by being blown from one arm 20 to the other arm 30, and back again through the apparatus 10. However, some minor amount of blown air can escape into ambient air surrounding the apparatus 10 even when the apparatus is in its closed position. As shown in FIG. 3, the apparatus 10 in one embodiment optionally comprises at least one first arm ambient air vent 29 for intake of ambient air. In another preferred embodiment, the apparatus 10 can comprise at least one ambient air vent on each arm, 20, 30 namely, vent 29 on the first arm 20 and vent 39 on the second arm 30. The orifices 25, 26, 35, 36 and vents 29, 39 can optionally comprise a screen or a mesh across each orifice or vent to keep debris and hair out of the orifices.

As shown in FIG. 3, an embodiment of the apparatus 10 optionally can comprise a first surface heater 28 to heat the styling surface 24 of the first opposed arm 20. Another embodiment optionally comprises a second surface heater 38 to heat the styling surface 34 of the second opposed arm 30. In a preferred embodiment, the surface heaters 28, 38 can be PTC ("positive temperature coefficient") heaters or MCH ("metal ceramic heaters") heaters. A switch 58, shown in FIG. 2, can control any blower 40, 50, surface heater 28, 38 or air heater 42, 52 of the apparatus 10.

The first and second arms 20, 30 preferably comprise styling heads 23, 33. These heads 23, 33 provide the styling surfaces 24, 34, one or more blower 40, 50 and at least one ambient air vent 29, 39.

Hair positioned between the two styling surfaces 24, 34 is agitated by the blowers sufficiently to dislodge from one another wet hair strands stuck together by water, and so dry freshly washed hair while still maintaining hair between those surfaces 24, 34. These surfaces can be heated and flanked by styling combs or brushes that further shape the hair and style it while it is being dried. The drying hair is not scorched and does not become frizzy because it is maintained in a defined space while it dries and becomes styled. As a result, hair is dried much more quickly than by using a conventional hot air dryer alone. Additional drying and styling can be effected by heating the surfaces 24 and 34.

As shown in FIGS. 1 through 3, the apparatus 10 can comprise a plurality of hair separating and styling projections 54 mounted on a removable attachment 56. The attachment 56 is adapted to fit onto the distal end of either arm 20, 30 of the apparatus 10. Optionally, the attachment 56 is adapted to fit onto either styling head 23, 33. In a preferred embodiment, these hair separating projections 54 can comprise one or more comb or one or more array of bristles aligned along both edges 54, 56 of the styling heads 23, 33. The projections 54, 56 can extend beyond the styling surface 24, 34 of the head upon which the attachment is attached 21, 31. Optionally, as shown in FIG. 4, the hair separating projections 54, 56 can be permanently mounted directly onto the apparatus 10.

A user can style hair using this apparatus 10 by grasping the apparatus 10, placing hair between the arms of the apparatus with the arms in the open position; moving the arms to the closed position; and activating the blower(s) and heater(s) to blow heated air through the discharge orifices and suck air into the suction orifices while moving the arms through the hair. Usually the user moves the closed apparatus 10 away from the user's scalp along the length of the hair until reaching the end of the hair. When the end of the hair is reached, the apparatus 10 can then be moved into the open position and repositioned to dry and style a new section of the user's wet hair.

Thus the apparatus 10 allows energy efficient, fast drying and styling of hair at the same time with a single tool, thereby overcoming disadvantages of prior art systems.

Various embodiments of styling heads, styling surfaces, arms, heaters and blowers of the apparatus have been described herein. As will be appreciated by one of ordinary skill in the art, different movable connectors, shapes and number of orifices and vents, coverings for such orifices and vents, and positions of the styling heads along the length of the arms can be used. Moreover, additional arrays of comb teeth and brush bristles can be provided as a kit along with the base apparatus. Additionally, although specific means and configurations have been described, it will be appreciated that modifications can be made to such means and configurations while still remaining within the scope of the appended claims. For example, it is not necessary to use an apparatus of the present invention simply to dry hair; it can be used just for styling already dried hair.

The first and second arms can be made from heat resistant material such as polycarbonate with the styling surfaces made from aluminum. Such a version may have 20 suction orifices of an approximate diameter of 2 millimeters and 20 discharge orifices of an approximate diameter of 2 mm on each styling surface. The first and second blowers can be cross-flow fans and the heaters for heating air blown can be coiled nichrome wire. The styling surface heaters can be metal ceramic heaters. The ambient air orifice can have the dimension of 2 mm by 80 mm, and can be covered with a mesh made of stamped aluminum. The hair separating projections can be 20 bundles of 24 bristles each, with each bristle made from polyamide. The removable apparatus can be made of polyamide and can snap-fit onto a styling head of the apparatus. Although the present invention has been described in considerable detail with reference to certain preferred versions thereof, other versions are possible, for example, scissor arms instead of clam shells. Therefore, the spirit and scope of the appended claims should not be limited to the description of the preferred versions contained herein.

All the features disclosed in this specification (including any accompanying claims, abstract, and drawings) may be replaced by alternative features serving the same, equivalent or similar purpose, unless each feature disclosed is one example only of a generic series of equivalent or similar features.

What is claimed is:

1. A hair styling apparatus comprising:

a) first and second opposed styling arms, each arm having a proximal section, a distal section, and a longitudinal axis extending from the proximal section to the distal section, each arm having a styling head at the distal section, the styling arms being pivotally connected to each other at the proximal section with an open position for placement of hair between the styling heads and a closed position for hair styling;

b) each styling head having a styling surface facing the other styling surface;

c) a discharge orifice and a suction orifice in the styling surface of both styling heads, wherein the discharge orifice and the suction orifice in each styling head are laterally spaced apart from each other, and the discharge orifices are located for discharging heated air and the suction orifices are located for sucking in discharged heated air, and the suction orifices and the discharge orifices are located so that placement of hair between the styling arms with the styling arms in the closed position has hair located over the suction orifices and the discharge orifices;

d) at least one air heater for heating air to be discharged and recycled air; and e) at least one blower positioned for blowing air through the discharge orifices and for sucking air from the suction orifices so that some heated air discharged by the discharge orifices is recycled by being sucked in through the suction orifices and reheated.

2. The apparatus of claim 1, further comprising a first electrical heater for heating the styling surface of the first styling arm.

3. The apparatus of claim 2, further comprising a second electrical heater for heating the styling surface of the second styling arm.

4. The apparatus of claim 1, wherein the apparatus comprises two blowers, one in each styling arm.

5. The apparatus of claim 4, wherein the apparatus comprises two air heaters, one in each styling arm, for heating air discharged by the discharge orifices.

6. The apparatus of claim 1, wherein the apparatus comprises two air heaters, one in each styling arm, for heating air discharged by the discharge orifices.

7. A hair styling apparatus comprising:

a) first and second opposed arms, each arm comprising a proximal section, a distal section, and a longitudinal axis extending from the proximal section to the distal section, each arm comprising a styling head at the distal section, each styling head comprising a styling surface facing the other styling surface, the arms being movably connected to each other at the proximal section with an open position for placement of hair therebetween and a closed position for hair styling;

b) a first discharge orifice and a first suction orifice positioned in the styling surface of the first arm, the first discharge orifice and the first suction orifice being laterally spaced apart from each other, wherein when hair is placed between the arms and the arms are moved to the closed position the hair is located over the first discharge orifice and the first suction orifice for hair styling;

c) a first heater for heating air to be discharged through the first discharge orifice and heating recycled air; and d) a first blower positioned for blowing air through at least the first discharge orifice and sucking heated air through at least the first suction orifice, wherein heated air discharged through the first discharge orifice is sucked through at least the first suction orifice for recycle through the first discharge orifice.

8. The apparatus of claim 7 comprising a second discharge orifice and a second suction orifice positioned in the styling surface of the second arm and a second blower for blowing air through the second discharge orifice, wherein when hair is placed between the arms and the arms are moved to the closed position the hair is located over the second discharge orifice and the second suction orifice.

9. The apparatus of claim 8 wherein air blown through the second discharge orifice is sucked from the second suction orifice.

10. The apparatus of claim 8 wherein air blown through the first discharge orifice is sucked from the second suction orifice.

11. The apparatus of claim 8 wherein air blown through the second discharge orifice is sucked from the first suction orifice.

12. The apparatus of claim 8 comprising a second heater for heating air blown by the second blower.

13. The apparatus of claim 8 wherein in the closed position, the first discharge orifice is at least partly directly opposed to the second suction orifice so that air blown through the first discharge orifice is sucked into the second suction orifice.

14. The apparatus of claim 7 wherein air blown through the first discharge orifice is sucked from the first suction orifice.

15. The apparatus of claim 7 comprising at least one ambient air vent for sucking air into the apparatus by the first blower.

16. The apparatus of claim 7 comprising a first electrical heater for heating the styling surface of the first arm.

17. The apparatus of claim 16 comprising a second electrical heater for heating the styling surface of the second arm.

18. The apparatus of claim 7 wherein the first discharge orifice and the first suction orifice are elongated.

19. The apparatus of claim 7 comprising a screen or a mesh across at least one of the first discharge orifice and the first suction orifice.

20. The apparatus of claim 7 comprising multiple discharge orifices and multiple suction orifices on the first arm.

21. The apparatus of claim 7 wherein the first blower is cross-flow fan blower.

22. The apparatus of claim 7 comprising a plurality of hair separating projections aligned along at least one edge of one of the styling surfaces.

23. A method for styling hair comprising the steps of:

a) grasping a hair styling apparatus, the hair styling apparatus comprising:

i) first and second opposed styling arms, each arm having a proximal section, a distal section, and a longitudinal axis extending from the proximal section to the distal section, each styling arm having a styling head at the distal section, the styling arms being pivotally connected to each other at the proximal section with an open position for placement of hair between the styling heads and a closed position for hair styling;

ii) each styling head having a styling surface facing the other styling surface;

iii) a discharge orifice and a suction orifice in the styling surface of both styling heads, wherein the discharge orifice and the suction orifice are laterally spaced apart from each other, and the discharge orifices are located for discharging heated air and the suction orifices are located for sucking in discharged heated air, and the orifices are located so that placement of hair between the styling arms with the styling arms in the closed position has hair located over the suction orifices and the discharge orifices;

iv) at least one air heater for heating air to be discharged and recycled air; and v) at least one blower positioned for blowing air through the discharge orifices and sucking air from the suction orifices so that some heated air discharged by the discharge orifices is recycled by being sucked in through the suction orifices and reheated;

b) placing hair between the styling arms of the apparatus with the styling arms in the open position so that when the styling arms are moved to the closed position the hair is over the discharge orifices and over the suction orifices;

c) moving the styling arms to the closed position so that hair is over the discharge orifices and the suction orifices; and d) after step c), blowing heated air from the first discharge orifice through the hair and into the second suction orifice, and sucking heated air from the second discharge orifice through the hair and into the first suction orifice, while moving the apparatus through the hair, thereby styling the hair.

24. The method of claim 23, wherein in step b), the hair is wet.

25. A method for styling hair comprising the steps of:

a) grasping a hair styling apparatus, the hair styling apparatus comprising:

i) first and second opposed arms, each arm comprising a proximal section, a distal section, and a longitudinal axis extending from the proximal section to the distal section, each arm comprising a styling head at the distal section, each styling head comprising a styling surface facing the other styling surface, the arms being movably connected to each other at the proximal section with an open position for placement of hair therebetween and a closed position for hair styling;

ii) a discharge orifice and a suction orifice positioned in the styling surface of the first arm, the discharge orifice and the suction orifice being laterally spaced apart from each other, wherein when hair is placed between the arms and the arms are moved to the closed position the hair is located over the discharge orifice and the suction orifice for hair styling;

iii) a heater for heating air discharged through the discharge orifice and heating recycled air; and iv) a blower positioned for blowing air through at least the discharge orifice and sucking air through at least the suction orifice, wherein heated air discharged through the discharge orifice is sucked through at least the suction orifice for recycle through the discharge orifice;

b) placing hair between the arms of the apparatus with the arms in the open position so that when the arms are moved to the closed position the hair is over the first discharge orifice and over the first suction orifice;

c) moving the arms to the closed position so that hair is over the discharge orifices and the suction orifices; and d) after step c), blowing air onto the hair and sucking air onto the hair for heating by the heater, thereby styling the hair.

26. The method of claim 25, wherein in step b), the hair is wet.

* * * * *